US005829159A

United States Patent [19]

Hodgins et al.

[11] Patent Number: 5,829,159

[45] Date of Patent: Nov. 3, 1998

[54] PAPER MACHINE FRAME INSTALLATION

[75] Inventors: Gary W. Hodgins, Trenton; Raymond P. Sitter; Roderick A. Spicer, both of Thunder Bay, all of Canada

[73] Assignee: Canadian Shipbuilding & Engineering Limited, Thunder Bay, Canada

[21] Appl. No.: 841,993

[22] Filed: Apr. 22, 1997

[30] Foreign Application Priority Data

Mar. 6, 1997 [CA] Canada ..... 2199328

[51] Int. Cl.[6] ..... D21F 5/00; D06F 58/00

[52] U.S. Cl. ..... 34/121; 34/646

[58] Field of Search ..... 34/442, 444, 459, 34/462, 466, 117, 121, 646; 52/66, 69

[56] References Cited

U.S. PATENT DOCUMENTS

| | | | |
|---|---|---|---|
| 3,123,449 | 3/1964 | Cocker, III | 34/121 |
| 3,359,646 | 12/1967 | Beachler | 34/121 |
| 3,989,587 | 11/1976 | Grossman | 162/200 |
| 4,165,590 | 8/1979 | Bartley | 52/66 |
| 4,450,630 | 5/1984 | Phelps | 34/121 X |
| 5,412,913 | 5/1995 | Daniels et al. | 52/79.13 |
| 5,557,856 | 9/1996 | Kertula | 34/117 |

FOREIGN PATENT DOCUMENTS

| | | |
|---|---|---|
| 237221 | 2/1930 | Canada . |
| 618855 | 5/1955 | Canada . |
| 1120260 | 3/1982 | Canada . |
| 1126013 | 6/1982 | Canada . |
| 1261140 | 9/1989 | Canada . |
| 1328167 | 4/1994 | Canada . |

*Primary Examiner*—Henry Bennett
*Assistant Examiner*—Steve Gravini
*Attorney, Agent, or Firm*—Rockey, Milnamow & Katz, Ltd.

[57] ABSTRACT

The dryer section of a paper-making machine is fabricated as a number of subsections arranged end-to-end throughout the length, the subsections each including a pair of prefabricated large vertical side frames which provide support for the dryer cans, felt rolls, etc. The subsections can be individually fabricated and do not require precise levelling relative to each other resulting in great improvements in the speed and cost of installation of the dryer section.

9 Claims, 3 Drawing Sheets

PAPER MACHINE FRAME INSTALLATION

BACKGROUND OF THE INVENTION a) Field of the Invention

This invention relates to a new or improved dryer section for a paper-making machine, and also to a new or improved frame assembly for use in such a dryer section and to a method of installation of the dryer section of the paper-making machine.

b) Description of the Prior Art

The dryer section of a paper-making machine of the type used throughout North America, is normally installed between the press section (at the "wet end" of the machine) and the calender stack and winder (at the "dry end" of the machine).

The purpose of the dryer section is to dry and condition on a continuous basis the paper sheet or web that is being manufactured, to achieve a specific grade or quality and which meets the requirements of the paper mill and the needs of the customer. It is essential to be able to maintain close control over the grade or quality of the product so that it can be duplicated as and when required.

As is well understood, the paper web is dried by running it successively over the surfaces of a series of large cylindrical heated dryer cans, during this process the web being carried by a felt belt which aids both in conveyance of the paper web and in the drying process. The number of dryer cans employed, the degree to which they are heated and the linear speed of operation of the machine are all relative to the type of paper product being produced and can be varied as conditions dictate.

Conventional dryer sections for paper-making machines are very expensive both to manufacture and install, and typically comprise longitudinal frames which are fabricated from a multitude of bolted-together cast iron or steel components erected on continuous sole plates spaced laterally at the drive side and tending side of the machine. The sole plates are mounted on the machine track beams of the building which houses the paper-making machine and run the length of the machine. This traditional design involves fabricating two continuous sole plates extending the entire length of the dryer section, each sole plate comprising a series of short plates which are laid on the machine track beam in abutting relationship and individually levelled and aligned.

The traditional method of installation requires the sole plates to be aligned and levelled over the entire length of the dryer section which typically would be of the order of 150 to 160 feet. It will be appreciated that this process is very time consuming and results in great delay during equipment installation requiring protracted mill shut-down and consequent loss of revenue. In practice little else can be assembled until the sole plate sections are installed, aligned, levelled, grouted in place and allowed to set.

Furthermore, the traditional design of the dryer section frame involves the use of a multitude of relatively small frame sections which have to be bolted together and to the sole plates during the erection process. Each of the multitude of components must be carefully machined, placed and fitted to ensure correct alignment as the dryer section is progressively erected, this being necessary not just in respect of the framing pieces, but also in respect of the cross-frame members, and the bearings for the dryer cans and felt rolls.

It has long been appreciated that the traditional systems for installing a dryer section were slow and costly.

SUMMARY OF THE INVENTION

The object of the present invention is to provide an improved dryer section and method for its assembly.

The invention provides a paper-making machine dryer section comprising: a series of subsections arranged end-to-end, each subsection including: a pair of transversely spaced horizontal sole plates extending in a longitudinal direction; a pair of transversely spaced vertical frame assemblies extending longitudinally each mounted on a respective one of said sole plates; a series of transverse cylindrical dryer cans and a series of transverse felt rolls, said dryer cans and said felt rolls extending horizontally between said frame assemblies; bearings associated with said respective frame assemblies and supporting said dryer cans and said felt rolls at opposite ends thereof for rotation about horizontal axes; and a dryer felt passing in a continuous loop over said dryer cans and said felt rolls to guide a paper web into contact with said dryer cans in succession; wherein each of said frame assemblies comprises a prefabricated rigid structure defining a plurality of first lateral openings spaced longitudinally therein, each first lateral opening being of a size sufficient to permit passage of dryer can laterally therethrough without disassembly of said frame assembly.

The invention also provides a prefabricated frame assembly for the dryer section of a paper-making machine, said frame assembly comprising: a first series of vertical columns spaced apart longitudinally and each having a lower end formed with a horizontal foot surface, said foot surfaces being coplanar; a first horizontal beam extending horizontally and rigidly integrally mounting said first vertical columns on the underside thereof; a second series of vertical columns spaced apart longitudinally at locations offset with respect to said first columns, said second columns being rigidly integrally interconnected to the upper side of said first horizontal beam; said first and second vertical columns defining above and below said horizontal beam respective upper and lower lateral openings each sized to accommodate passage therethrough of a dryer can.

The prefabricated rigid frame assembly is preferably a welded steel construction and may be designed to accommodate mountings for a series e.g. ten to twelve dryer cans arranged in upper and lower tiers. For example the dryer section of overall length 160 ft. may be subdivided into, say, four 40 ft. long subsections each of which comprises two unitary spaced apart frame assemblies each mounted on fully machined individually installed and levelled sole plate sections of corresponding length. The two sole plate sections under each subsection of the dryer need only be precisely aligned and levelled with respect to each other and located true to the machine center line. Precise alignment between the sole plates in successive subsections of the dryer section is not required.

From another aspect the invention provides a method of installing a dryer section in a paper-making machine, such dryer section having a series of elongate cylindrical dryer cans extending transversely therein and arranged in two vertically spaced tiers, with the dryer cans in one tier being offset longitudinally with respect to those of the other tier, said method comprising: (a) providing said dryer section as a plurality of subassemblies arranged successively end-to-end, (b) for each subassembly, providing, precisely aligning, locating and installing a pair of individual sole plates extending longitudinally of the dryer section in transversely spaced relationship, each said individual sole plate having a length corresponding to that of the associated subassembly, and (c) separately installing and erecting each said subassembly on its associated sole plates, each said subassembly being installed and erected in longitudinal alignment with but otherwise independently of the remaining subassemblies.

The concept of utilizing dryer subsections which with respect to each other are essentially "free-standing", permits early progression of the fabrication and assembly of one subsection while, say the sole plates for the succeeding subsection are being set, and where the foundation concrete is being poured for a further succeeding subsection. This dramatically reduces the time required to install the equipment and thus reduces lost production time at the mill. To minimize on-site installation delays, it is preferred for each subsection of the dryer section to be preassembled in a fabrication shop so that all equipment such as dryer cans, rollers, bearings etc. can be aligned, levelled, interconnected, dowelled and marked to ensure easy subsequent on-site installation.

BRIEF DESCRIPTION OF THE DRAWINGS

The invention will further be described, by way of example only, with reference to the accompanying drawings wherein:

Referring to FIG. 1, the prior art paper-making machine dryer section comprises a pair of longitudinally extending transversely spaced sole plates 11 (only one of which is shown in FIG. 1) mounted on a foundation 12. The sole plate has an overall length of 160 ft. (in this example) corresponding to the length of the dryer section and is formed by a series of steel plates 13 which are butted end-to-end and are precisely machined and installed so as to form a continuous horizontal top surface 14 which is in register with the top surface (not shown) of the parallel sole plate 11 on the opposite side of the machine.

The sole plate top surface 14 forms a reference plane with respect to which all components of the dryer section are located, and it is accordingly of critical importance for this top surface 14 to be accurately and precisely positioned. In the fabrication of the prior art dryer section, installation and precise location of the sole plates 11 along their entire lengths must be completed before the other components of the dryer section are added.

Figure 1:
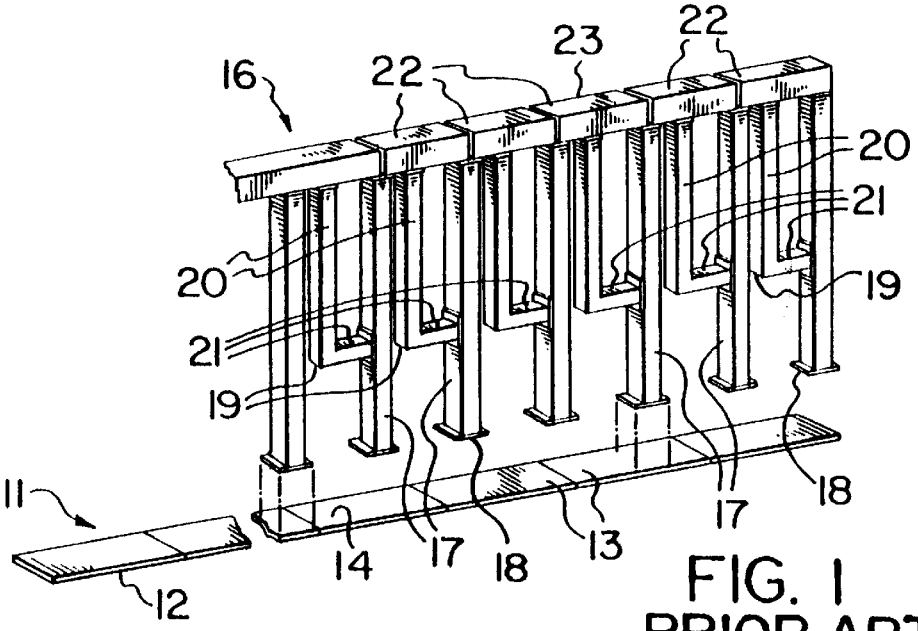
FIG. 1 PRIOR ART
FIG. 1 is a somewhat schematic fragmentary exploded perspective view of the framing arrangement for a paper-making machine dryer section as known in the prior art.
Figure 2:
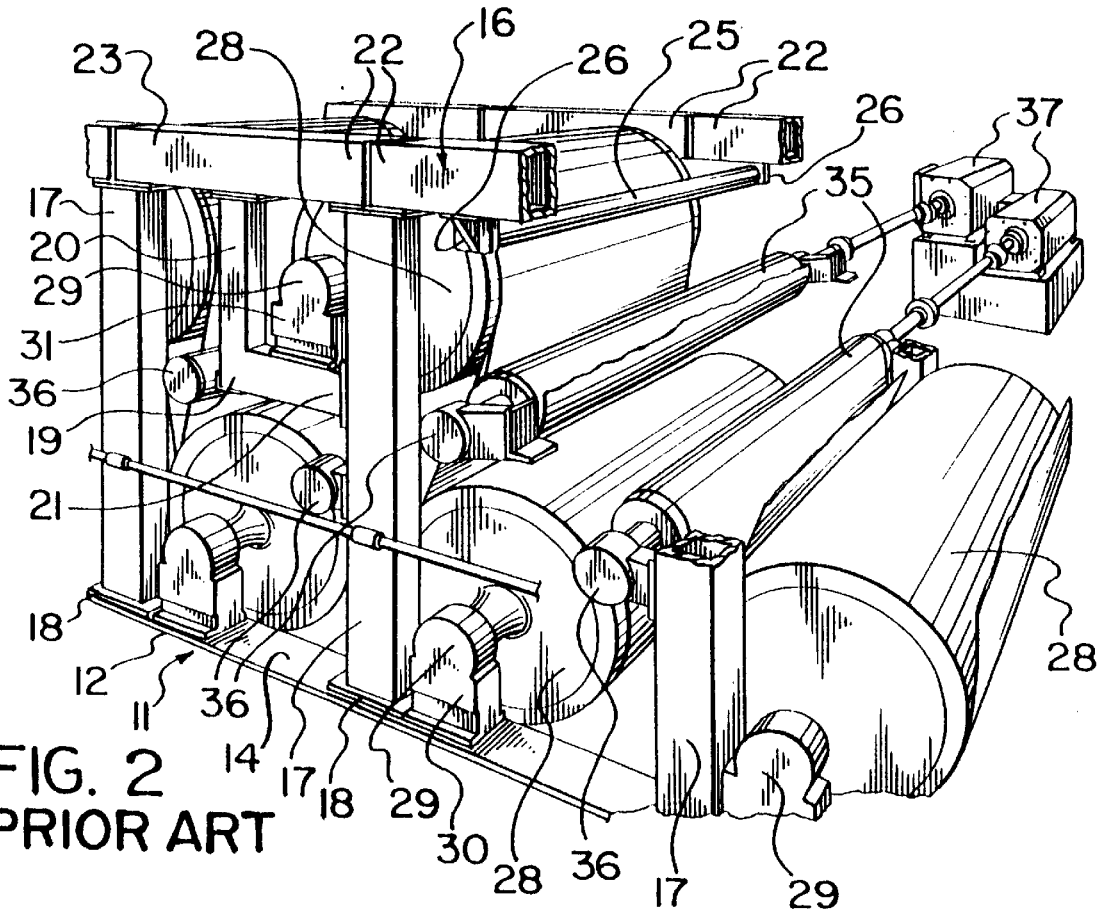
FIG. 2 PRIOR ART
FIG. 2 is a fragmentary perspective view showing a portion of a dryer section incorporating a framing arrangement as shown in FIG. 1.

With the sole plates 11 in position, the side frames 16 of the dryer section can be built up and the various other components installed. With reference to FIGS. 1 and 2, each side frame 16 is fabricated from a series of vertical columns 17 having flanged feet 18 which are precisely machined and dowelled for mating with the sole plate top surface 14, and are bolted to the sole plate at precise spacings along its length.

For each column 17 there is an associated L-shaped frame element 19 comprising a vertical limb 20 and a horizontal limb 21.

The upper ends of the columns 17 are precisely machined to support thereon individual sections 22 of a longitudinally extending frame beam 23. The horizontal limb of the L-shaped frame element is precisely machined and attached to the side of a column 17 whereas the vertical limb of the frame element 19 is precisely machined and attached to the underside of one of the frame beam sections 22.

The individual components of the side frames 16 are separately manufactured and machined, and fitted progressively together in situ during erection of the side frame. It will be appreciated that this is of necessity a slow time-consuming process and typically will involve additional machining, fitting and the application of shims and spacers to ensure that the different components are precisely positioned in the finished frame. The manufacture and assembly typically will include the use of dowels and the like to ensure proper relative positioning of the different components, final assembly of the frame entailing the use of threaded bolts to interconnect the various components.

The two side frames 16 are transversely interconnected by cross beams 25 having ends affixed to brackets 26 on the respective side frames 16 so that the latter are interconnected to form a rigid frame structure extending the entire length of the dryer section.

The framing structure described forms a support framework for a series of dryer cans and felt rollers utilized for drying of the paper web. Typically, and as shown in FIG. 2 the dryer cans comprise large cylindrical drums of a diameter about 5 ft. which occupy substantially the entire width between the side frames 16, each dryer can being rotatably supported at its opposite ends in bearings 29. The dryer cans are arranged in upper and lower tiers, the lower tier bearings being supported on bolsters 30 attached to the sole plates 11 whereas the upper tier bearings 29 are carried by bolsters 31 which are mounted on the horizontal limbs 21 of the L-shaped frame elements 19.

As shown, the dryer cans 28 arranged in upper and lower tiers are spaced at regular intervals along the length of the dryer section, the upper tier dryer cans being offset longitudinally with respect to the lower tier dryer cans.

The side frames 16 also provide support for a series of felt rolls 35 which extend parallel to the dryer cans 28 and which are located to guide pairs of felt belts (not shown) each arranged in a continuous loop to direct the paper web successively over the dryer cans of the upper or lower tier. The felt rolls are mounted at opposite ends in bearings 36 attached at suitable locations on the side frames 16. Selected ones of the felt rolls 35 are rotatably driven by drive mechanisms 37 positioned at the rear or drive side of the dryer section.

As will be understood, each of the side frames 16 comprises a large number of individual columns 17, L-shaped frame elements 19 and frame beam sections 22. Each of these components is separately fabricated either as an iron casting or as a steel weldment. These individual components must be accurately machined and then individually installed and bolted together to gradually build up the complete frame assembly. It will be appreciated that such installation is necessarily time consuming and may entail additional on-site machining and fitting of the components as well as the use of spacers, shims, and the like. All components must be registered and levelled with reference to the respective sole plate 11 throughout the length of the dryer section, which, as mentioned, will typically be the order of 160 ft.

Figure 3:
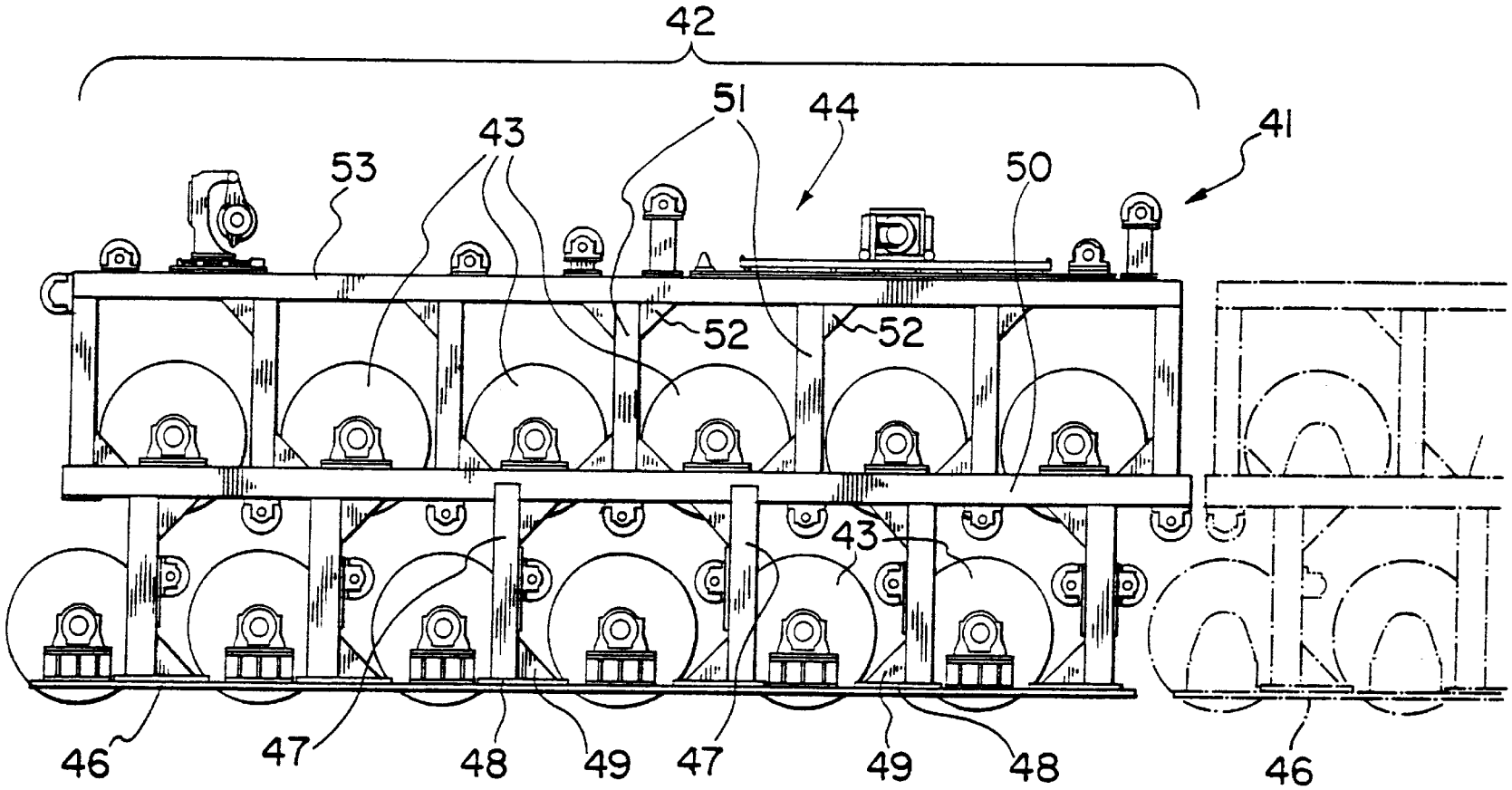
FIG. 3 is a somewhat schematic side elevation showing one subsection of the dryer section of a paper-making machine in accordance with the present invention.
Figure 4:
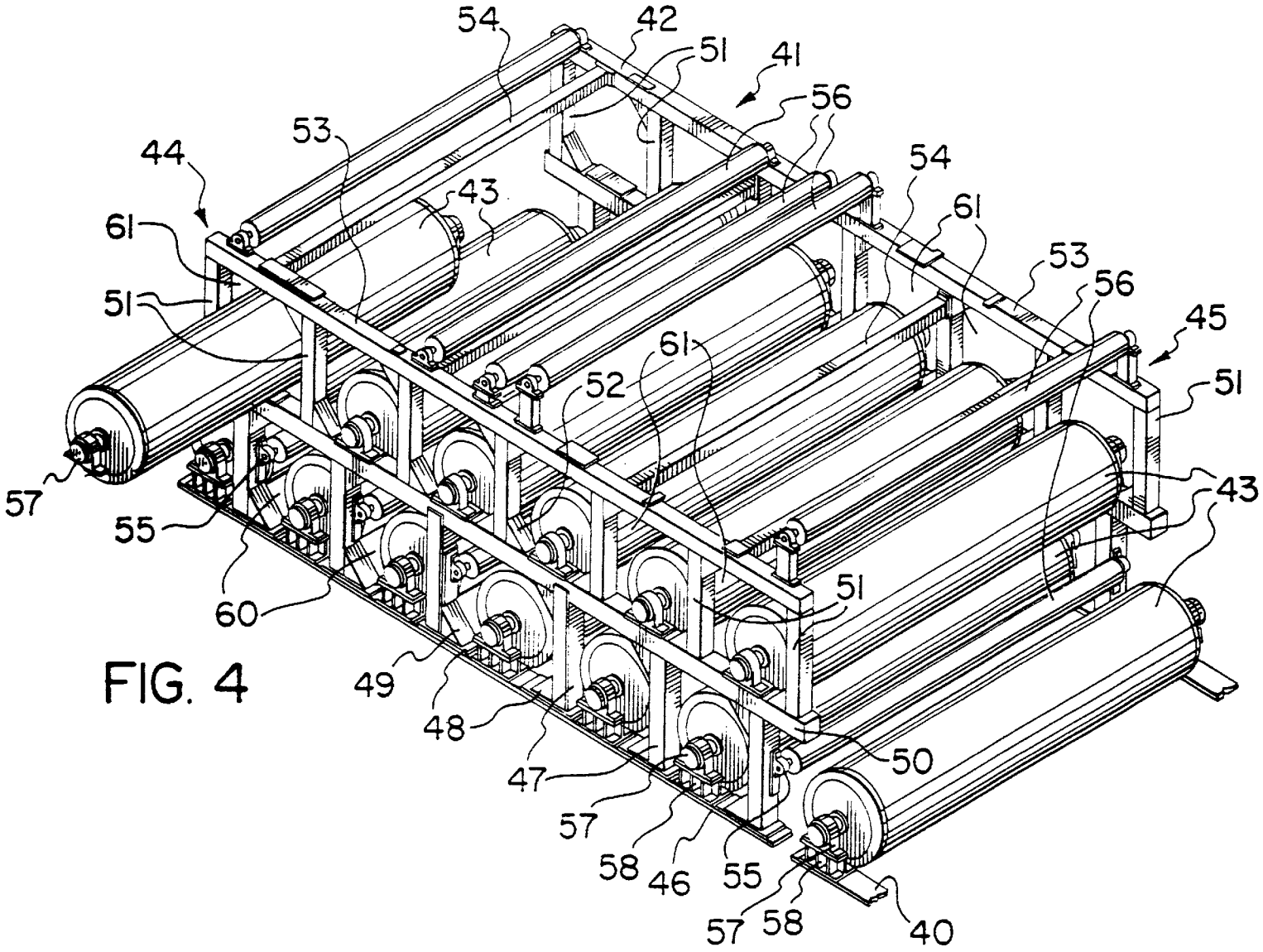
FIG. 4 is a somewhat schematic isometric view of the main component of dryer subsection shown in FIG. 3.

In accordance with the present invention, the dryer section 41 of the paper-machine with overall length of 160 ft. is designed as comprising four subsections 42 arranged end-to-end, each subsection having a length of approximately 40 ft. and accommodating therein a large group of dryer cans. Specifically, with reference to FIG. 3, one subsection 42 is illustrated as incorporating a total of twelve dryer cans 43 arranged alternately in upper and lower levels or tiers, the upper dryer cans being longitudinally offset with respect to the lower dryer cans. As shown in FIGS. 3 and 4, each dryer subsection 42 comprises two transversely spaced longitudinally extending frame assemblies 44, 45 each mounted on a respective sole plate section 46 which has a length corresponding to that of the subsection 42. The sole plate sections 46 of the individual dryer subsections 42 are precisely located, installed and levelled with respect to each other in the transverse direction of the machine. However the sole plates of successive subsections 42, although precisely aligned in the machine direction, do not require exact levelling etc. relative to one another, and accordingly the individual dryer subsections 42 can be individually fabricated and installed.

Each frame assembly 44, 45 comprises a series of regularly spaced lower vertical columns 47 each formed at its lower end with a flanged foot 48 which is elongated in the longitudinal direction and which is braced to the column by a triangular gusset plate 49 welded thereto. The upper end of each of the columns 47 is rigidly attached to the underside of a longitudinally extending horizontal beam 50. Above the beam 60 there is a second row of upwardly projecting vertical columns 51 rigidly affixed to the beam and selectively braced thereto by triangular gusset plates 52, the upper ends of the columns 51 being interconnected by a longitudinally extending head beam 53. The tending side frame assembly 44 is a substantial mirror image of the drive side frame assembly 45 as will be understood, the columns 47, 51 and the horizontal beams 50 and 52 of the two frame assemblies being in register with one another on opposite sides of the machine.

Each of the frame assemblies 44, 45 is fabricated and machined as an integral assembly and is then erected in vertical position on the respective sole plate section 46 in precise transverse register, the frame assemblies 44, 45 being interconnected by cross ties 54 rigidly interconnected thereto.

Each of the frame assemblies 44, 45 is formed as a massive weldment of individual hollow box-section steel components which are separately fabricated and then brought together for assembly in a suitable jig or fixture (not shown) in a manner well understood in the art, the individual components then being permanently interconnected by welding to form the overall frame assembly 44, 45. Upon fabrication, the frame assembly 44, 45 can be machined at a unitary structure, e.g. utilizing a large scale milling or jig boring machine, to prepare precise surfaces and locations for installation of the frame assembly on its respective sole plate section 46, and for the attachment of further components of the dryer subsection during installation and assembly of the latter. Thus the opposed frame assemblies 44, 45 provides mountings for the bearings 55 for supporting the opposite ends of a series of felt rolls 56. The horizontal beam 50 provides spaced mountings for the bearings 57 of the upper tier of dryer cans 43 whereas bolsters 58 attached to the sole plate section 46 support bearings 57 for the dryer cans of the lower tier.

As will be evident, the lower vertical columns 47 define therebetween large lateral openings 60 in the side frame assemblies 44, 45, similar openings 61 being defined between the upper columns 51 along each of the side frame assemblies 44, 45. These openings 60, 61 are of sufficiently large size to provide clearance for the passage therethrough of the dryer cans 43 as indicated at the left hand end in FIG. 4, so that these dryer cans can be installed and replaced individually without requiring any disassembly of the frame assemblies 44, 45, other than the disengagement of the bearings 57 and (where provided) the bolsters 58.

From the foregoing it will be understood that the disclosed novel dryer section framing arrangement and method of installation offer very significant advantages as compared to the prior art practice. By arranging the dryer section in the described subsections which can be individually assembled and erected, the time required to install the dryer section is very much reduced effecting a corresponding reduction in lost production time of the paper mill.

To ensure that all major components can be erected and installed on-site in a timely fashion, each dryer subsection is preferably preassembled in the fabrication shop. The dryer cans and felt rollers complete with bearings and housings are installed in the prefabricated frame assemblies 44, 45 and are assembled to mating sole plate fixtures (not shown), all equipment being aligned, levelled, bolted together, dowelled and match marked during this preassembly step so that the equipment when delivered to the mill for installation can be set in place quickly and efficiently with minimal adjustment and fitting requirements.

The open design of the frame assemblies 44, 45 permit ease of maintenance for servicing, the provision or removal of machinery such as dryer cans and felt rolls from within the frame structure being possible through the tending side of the frame without any requirement for dismantling of the frame sections or disturbing any large number of other components.

The frame design is preferably based on the principle that the dryer section is of felt driven design, and only some of the felt rollers are driven. This results in an uncluttered frame layout free from gears, gear boxes, etc. and their concomitant maintenance and repair/replacement concerns.

The open frame design also permits better air flow from one side of the machine to the other without dead spots, so that there results a better and more consistent moisture profile in the paper web being produced.

Additionally, the open frame design is easy to maintain in terms of cleanliness and lacks inaccessible areas which might accumulate debris and the like.

As noted, the novel design and method of assembly of the dryer section results in significant cost advantages. The frame assemblies are manufactured from hollow steel sections welded together to provide a clean structure that is easy to machine and easy to maintain. It is possible to machine all surfaces on the frame (which is 40 ft. long by 14 ft. high) true to the base line (sole plate) or perpendicular to it within ±0.005 inches.

The sole plate sections 46 are fabricated from smaller individual plates (e.g. 20 ft. long by 16 inches wide by 2½ inches thick) machined on all six sides and interconnected to precisely match the length of the modular frame assemblies 44, 45 (in this example).

The novel dryer section design has been estimated to reduce by more than 50% the industry standard down time of the mill required for installation of the dryer section. Given the high productivity of modern day paper mills, such a saving, e.g. of the order of 20 or more mill operating days, represents a very significant economic benefit.

While presently preferred embodiments of the invention are shown in the drawings and discussed in the foregoing, it should be understood that the invention is not restricted to the precise structures and features disclosed, but rather is intended to encompass all such structures as are included within the scope of the appended claims.

We claim:

1. A paper-making machine dryer section comprising:

a series of subsections arranged end-to-end, each subsection including:

a pair of transversely spaced horizontal sole plates extending in a longitudinal direction;

a pair of transversely spaced vertical frame assemblies extending longitudinally each mounted on a respective one of said sole plates, each said frame assembly comprising a longitudinally extending horizontal beam, and a plurality of longitudinally spaced first integral columns extending downwardly from said beam, each said column having a lower end defining a foot that is supported on said sole plate;

a series of transverse cylindrical dryer cans and a series of transverse felt rolls, said dryer cans and said felt rolls extending horizontally between said frame assemblies;

bearings associated with said respective frame assemblies and supporting said dryer cans and said felt rolls at opposite ends thereof for rotation about horizontal axes; and a dryer felt passing in a continuous loop over said dryer cans and said felt rolls to guide a paper web into contact with said dryer cans in succession;

wherein each of said frame assemblies comprises a prefabricated rigid structure defining between said first integral columns a plurality of first lateral openings spaced longitudinally therein, each first lateral opening being of a size sufficient to permit passage of dryer can laterally therethrough without disassembly of said frame assembly.

2. A dryer section as claimed in claim 1 wherein said bearings that rotatably support said dryer cans are each mounted on a respective sole plate at a location that is longitudinally offset from adjacent first columns.

3. A dryer section as claimed in claim 1 including a plurality of second integral columns extending upwardly from said beam and defining therebetween a plurality of second lateral openings each of which is of a size corresponding to that of said first lateral openings.

4. A dryer section as claimed in claim 3 including a dryer can corresponding to each one of said plurality of first and second lateral openings, said dryer cans being arranged in two tiers at respective upper and lower levels, the bearing for supporting dryer cans of the lower level being carried on the respective sole plates at a location offset from adjacent first columns, whereas the bearings for supporting the dryer cans of the upper level are mounted on said horizontal beam each at a location offset from adjacent second columns.

5. A dryer section as claimed in claim 4 including a longitudinally extending top beam integrally interconnecting the upper ends of said second integral columns.

6. A dryer section as claimed in claim 4 wherein said dryer cans of the upper level are longitudinally offset with respect to the dryer cans of the lower level.

7. A prefabricated frame assembly for the dryer section of a paper-making machine, said frame assembly comprising:

a first series of vertical columns spaced apart longitudinally and each having a lower end formed with a horizontal foot surface, said foot surfaces being coplanar;

a first horizontal beam rigidly integrally mounting said first vertical columns on the underside thereof;

a second series of vertical columns spaced apart longitudinally at locations offset with respect to said first columns, said second columns being rigidly integrally interconnected to the upper side of said first horizontal beam;

said first and second vertical columns defining above and below said horizontal beam respective upper and lower lateral openings each sized to accommodate passage therethrough of a dryer can.

8. A prefabricated frame assembly as claimed in claim 7 wherein the upper ends of said second vertical columns are interconnected by a longitudinally extending head beam and wherein said horizontal beam provides on its upper side between adjacent second columns mounting locations for the attachment of bearings for said dryer cans.

9. A prefabricated frame assembly as claimed in claim 7 comprising a prefabricated welded steel assembly.

* * * * *